US008172360B2

(12) United States Patent
Tay et al.

(10) Patent No.: US 8,172,360 B2
(45) Date of Patent: May 8, 2012

(54) PRINTHEAD SERVICING SYSTEM AND METHOD

(75) Inventors: Chiok Liang Tay, Singapore (SG); Kok Weng Chan, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 679 days.

(21) Appl. No.: 12/257,727

(22) Filed: Oct. 24, 2008

(65) Prior Publication Data

US 2009/0213170 A1 Aug. 27, 2009

Related U.S. Application Data

(60) Provisional application No. 61/031,972, filed on Feb. 27, 2008.

(51) Int. Cl.
*B41J 1/165* (2006.01)

(52) U.S. Cl. ..... 347/30

(58) Field of Classification Search ..... None
See application file for complete search history.

(56) References Cited

U.S. PATENT DOCUMENTS

| | | | | |
|---|---|---|---|---|
| 4,543,589 | A | 9/1985 | Terasawa | |
| 4,567,494 | A | 1/1986 | Taylor | |
| 4,853,717 | A | 8/1989 | Harmon et al. | |
| 5,426,456 | A | 6/1995 | Kuelzer et al. | |
| 5,448,270 | A | 9/1995 | Osborne | |
| 5,614,929 | A | 3/1997 | Dangelo et al. | |
| 5,621,441 | A | 4/1997 | Waschhauser et al. | |
| 5,717,444 | A | 2/1998 | Sugimoto et al. | |
| 6,017,109 | A | 1/2000 | Saijo | |
| 6,179,404 | B1 * | 1/2001 | Kawarama et al. | 347/31 |
| 6,390,593 | B1 | 5/2002 | DeRoos et al. | |
| 6,481,287 | B1 | 11/2002 | Ashworth et al. | |
| 6,481,825 | B1 | 11/2002 | Hinami et al. | |
| 6,481,827 | B2 | 11/2002 | Yearout | |
| 6,550,890 | B2 | 4/2003 | Saijo | |
| 6,641,250 | B2 | 11/2003 | Saito | |
| 6,827,422 | B2 * | 12/2004 | Horie | 347/29 |
| 6,896,352 | B2 | 5/2005 | Miyauchi | |
| 2003/0043225 | A1 | 3/2003 | Cipolla et al. | |
| 2003/0081052 | A1 | 5/2003 | Urrutia et al. | |
| 2005/0128241 | A1 | 6/2005 | Kulpa | |

FOREIGN PATENT DOCUMENTS

| | | |
|---|---|---|
| DE | 199 34 426 A 1 | 7/1999 |
| JP | 05-084918 | 4/1993 |
| JP | 11-207978 | 8/1999 |

* cited by examiner

*Primary Examiner* — Stephen Meier
*Assistant Examiner* — Alexander C Witkowski

(57) ABSTRACT

A system for servicing a printhead having a plurality of orifices formed in a face thereof includes a cap configured to mate with the face of the printhead; a porous material provided in the cap, wherein the porous material has a first side arranged to face the face of the printhead and a second side opposite the first side; and a vacuum communicated with the cap, wherein the vacuum is configured to draw fluid from the orifices of the printhead through the porous material provided in the cap. The second side of the porous material has a recess formed therein such that the vacuum is communicated with the recess.

20 Claims, 4 Drawing Sheets

PRINTHEAD SERVICING SYSTEM AND METHOD

CROSS REFERENCE TO RELATED APPLICATIONS

This Application claims the benefit of provisional patent application Ser. No. 61/031,972, filed Feb. 27, 2008 titled "PRINTHEAD SERVICING SYSTEM AND METHOD" which application is incorporated by reference herein as if reproduced in full below.

BACKGROUND

An inkjet printing system may include a printhead and an ink supply which supplies liquid ink to the printhead. The printhead ejects drops of the ink through a plurality of nozzles or orifices and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

During use and/or non-use of the printhead, it is possible for the orifices to become clogged with ink and/or for bubbles of air to be trapped within the printhead in such a manner as to interfere with proper operation of the printhead. In addition, it is desirable to prevent ink from drying in the orifices when the printhead is not in use, and to clear out soft viscous plugs of ink which may form in the orifices when the printhead is not in use.

For these and other reasons, a need exists for the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
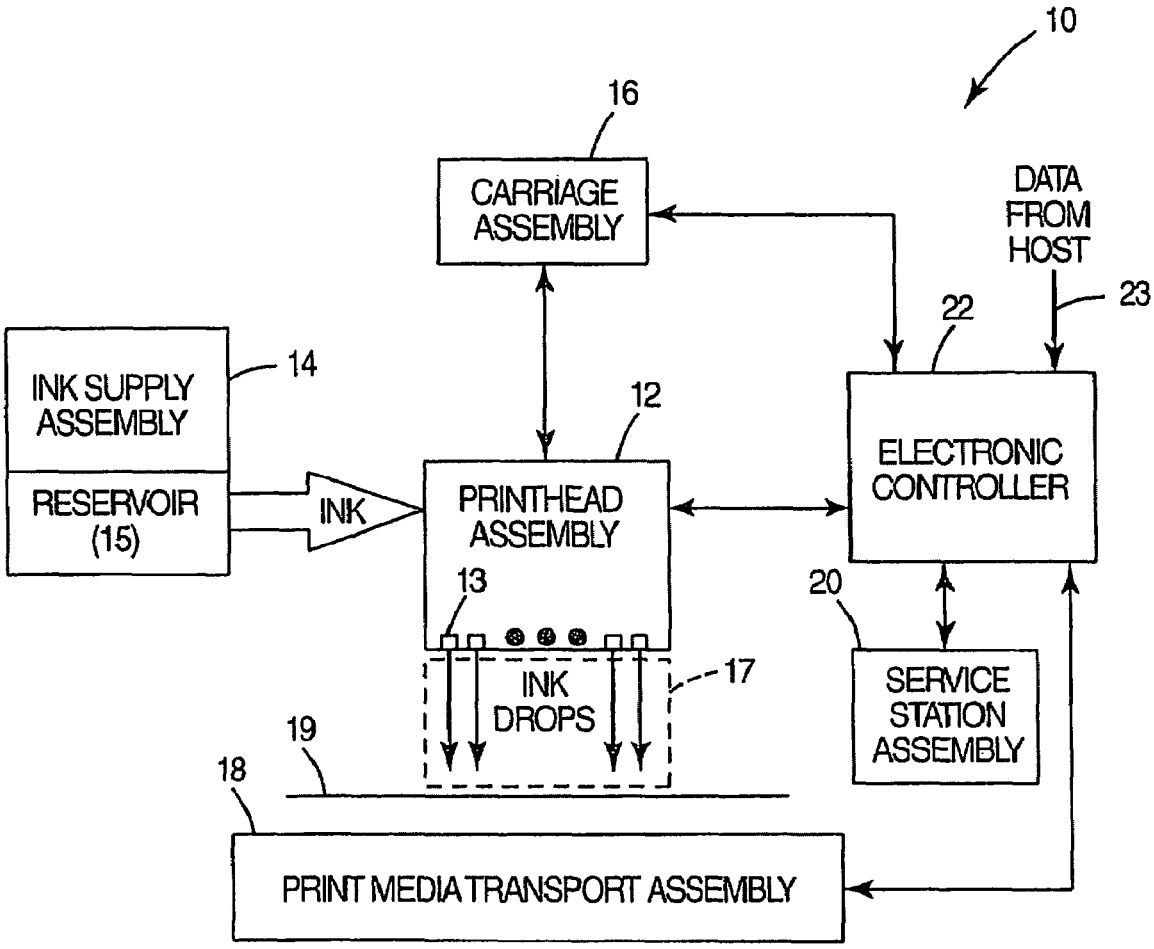
FIG. 1 is a block diagram illustrating one embodiment of an inkjet printing system according to an embodiment of the present invention.

FIG. 1 illustrates one embodiment of an inkjet printing system 10 according to embodiments of the present invention. Inkjet printing system 10 includes an inkjet printhead assembly 12, an ink supply assembly 14, a carriage assembly 16, a print media transport assembly 18, a service station assembly 20, and an electronic controller 22.

Inkjet printhead assembly 12 includes one or more printheads which eject drops of ink through a plurality of nozzles or orifices 13 and toward an embodiment of media, such as print medium 19, so as to print onto print medium 19. Print medium 19 is any type of suitable sheet material, such as paper, card stock, transparencies, Mylar, cloth, and the like. Typically, orifices 13 are arranged in one or more columns or arrays such that properly sequenced ejection of ink from orifices 13 causes characters, symbols, and/or other graphics or images to be printed upon print medium 19 as inkjet printhead assembly 12 and print medium 19 are moved relative to each other.

Ink supply assembly 14 supplies ink to inkjet printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Carriage assembly 16 positions inkjet printhead assembly 12 relative to print media transport assembly 18 and print media transport assembly 18 positions print medium 19 relative to inkjet printhead assembly 12. Thus, a print zone 17 is defined adjacent to orifices 13 in an area between inkjet printhead assembly 12 and print medium 19.

In one embodiment, inkjet printhead assembly 12 is a scanning type printhead assembly such that carriage assembly 16 moves inkjet printhead assembly 12 relative to print media transport assembly 18 and print medium 19 during printing on print medium 19. In another embodiment, inkjet printhead assembly 12 is a non-scanning type printhead assembly such that carriage assembly 16 fixes inkjet printhead assembly 12 at a prescribed position relative to print media transport assembly 18 during printing on print medium 19 as print media transport assembly 18 advances print medium 19 past the prescribed position.

To maintain a functionality of inkjet printhead assembly 12 and, more specifically, orifices 13 of inkjet printhead assembly 12, service station assembly 20 provides for spitting, wiping, capping, and/or priming of inkjet print assembly 12. In one embodiment, service station assembly 20 includes a rubber blade or wiper which is periodically passed over inkjet printhead assembly 12 to wipe and clean orifices 13 of excess ink. In one embodiment, service station assembly 20 includes a cap which covers inkjet printhead assembly 12 to protect orifices 13 from drying out during periods of non-use. In one embodiment, service station assembly 20 includes a spittoon into which inkjet printhead assembly 12 ejects ink to insure that reservoir 15 maintains an appropriate level of pressure and fluidity and that orifices 13 do not clog or weep.

Electronic controller 22 communicates with inkjet printhead assembly 12, carriage assembly 16, print media transport assembly 18, and service station assembly 20. Electronic controller 22 receives data 23 from a host system, such as a computer, and includes memory for temporarily storing data 23. Typically, data 23 is sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one embodiment, electronic controller 22 provides control of inkjet printhead assembly 12 including timing control for ejection of ink drops from orifices 13. As such, electronic controller 22 defines a pattern of ejected ink drops which form characters, symbols, and/or other graphics or images on print medium 19. Timing control and, therefore, the pattern of ejected ink drops, is determined by the print job commands and/or command parameters.

Figure 2:
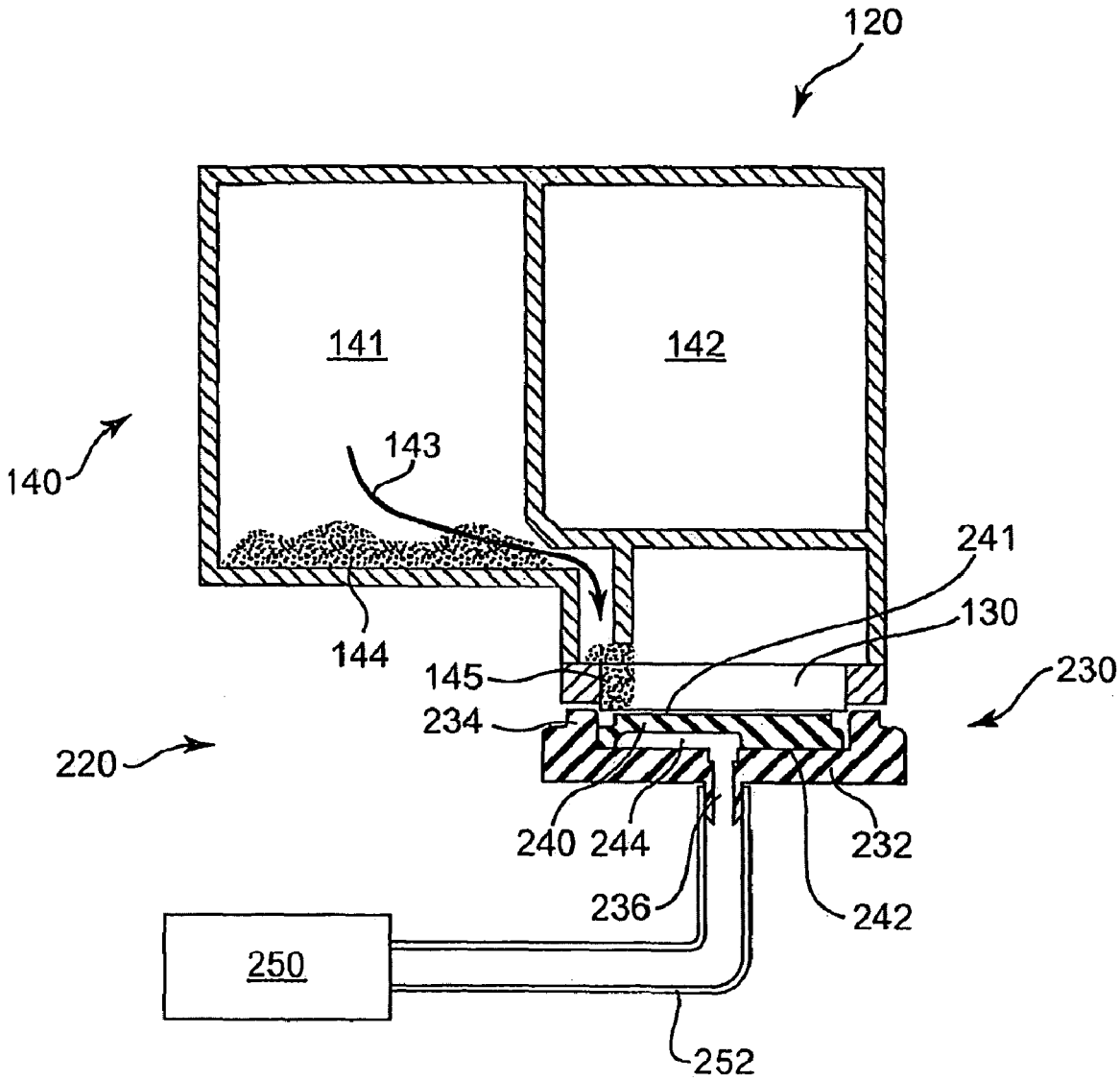
FIG. 2 is a schematic cross-sectional view illustrating one embodiment of a portion of an inkjet printing system according to an embodiment of the present invention.
Figure 3:
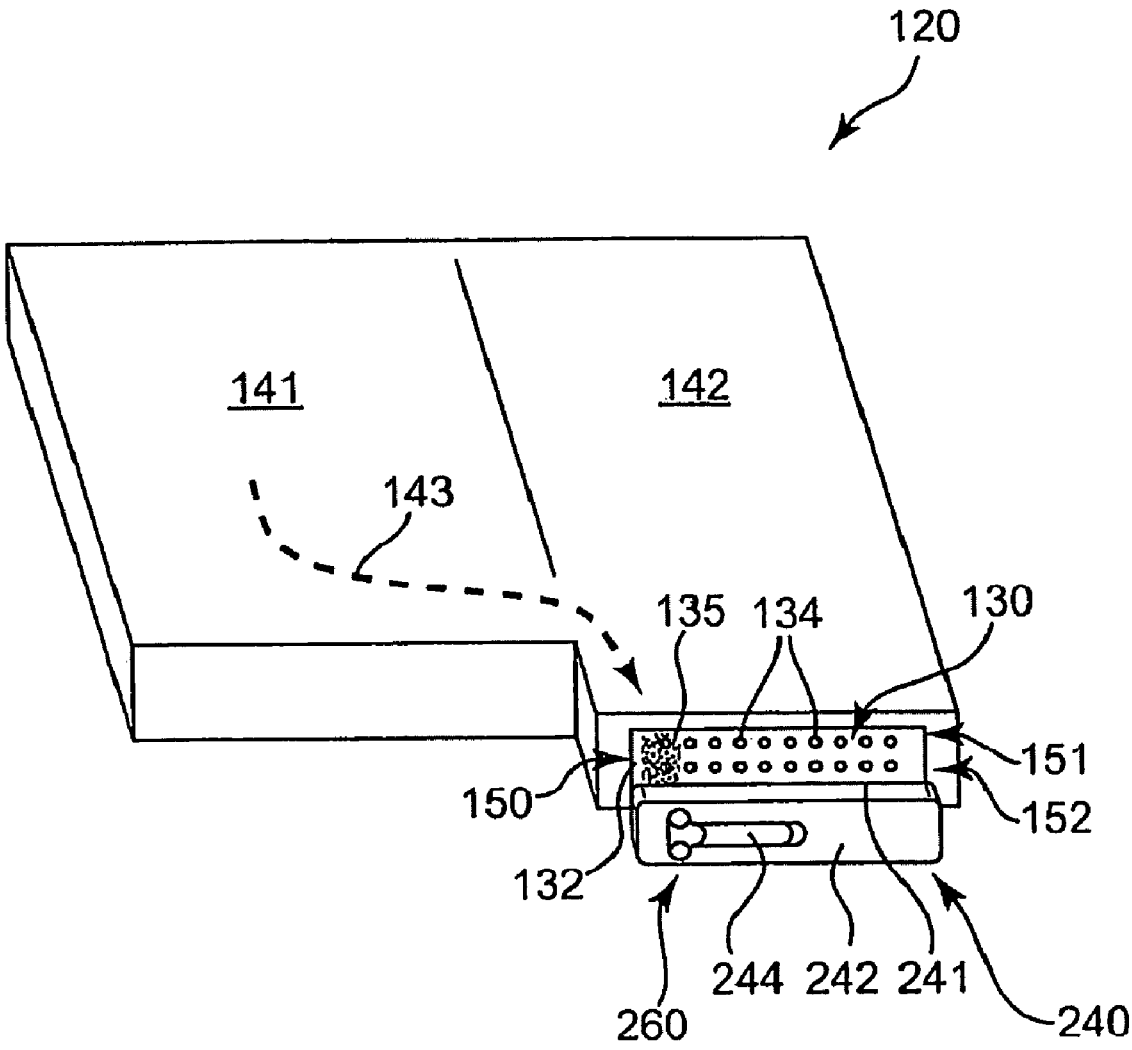
FIG. 3 is a schematic bottom perspective view illustrating one embodiment of a portion of an inkjet printing system according to an embodiment of the present invention.
Figure 4:
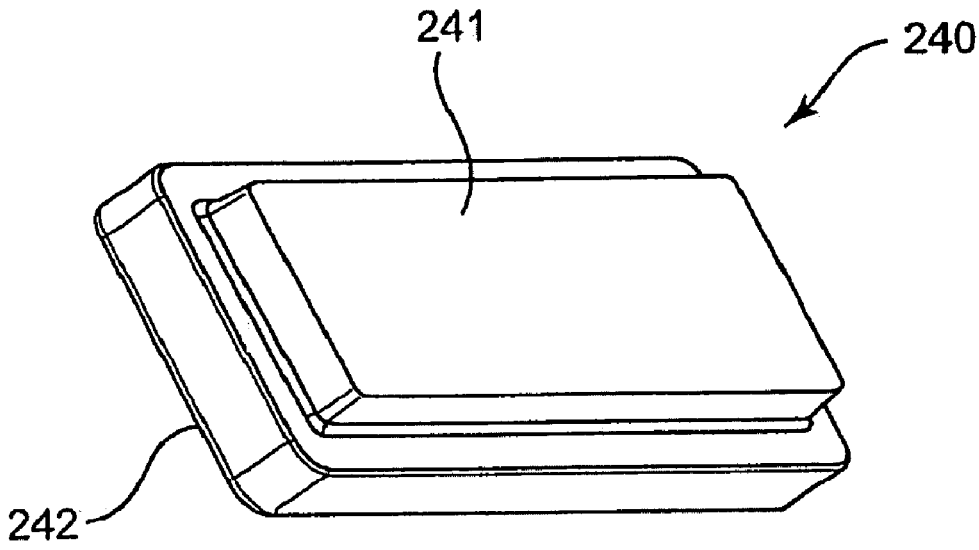
FIG. 4 is a top perspective view illustrating one embodiment of a porous material of a servicing system for an inkjet printing system according to an embodiment of the present invention.
Figure 5:
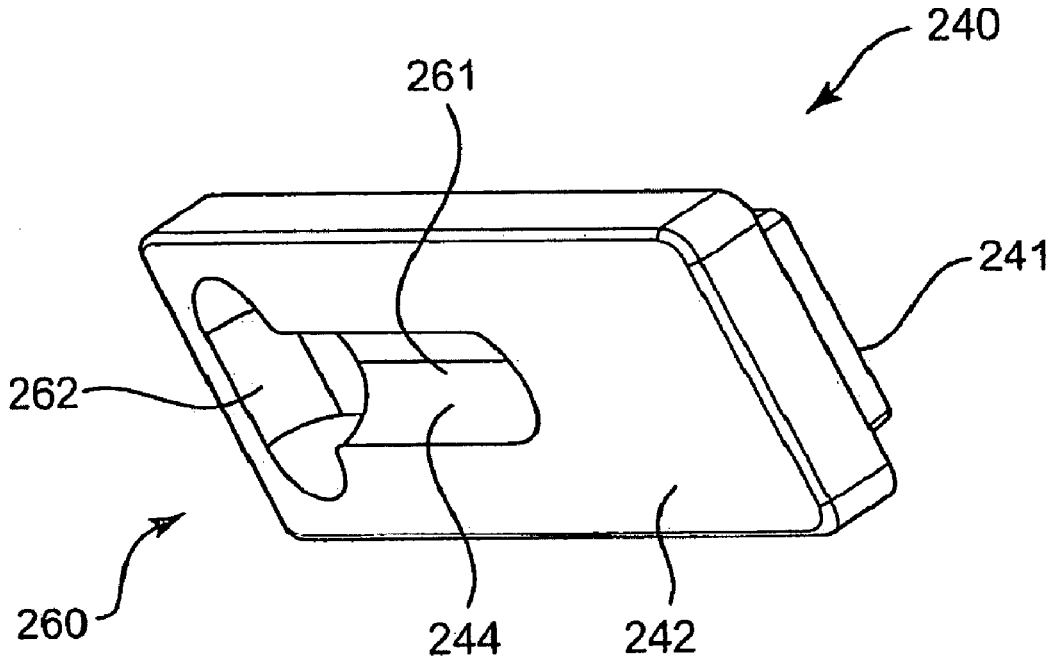
FIG. 5 is a bottom perspective view illustrating one embodiment of a porous material of a servicing system for an inkjet printing system according to an embodiment of the present invention.

FIGS. 2 and 3 illustrate a portion of an inkjet printhead assembly 120, as one embodiment of inkjet printhead assembly 12, and a portion of a service station assembly 220, as one embodiment of service station assembly 20. In one embodiment, inkjet printhead assembly 120 is an inkjet print cartridge or pen, and includes a printhead 130 and one or more reservoirs or compartments 140 for storing and supplying ink (or fluid) to printhead 130. In one embodiment, compartments 140 include a first ink compartment 141 for storing and supplying a first color ink to printhead 130, and a second ink compartment 142 for storing and supplying a second color ink to printhead 130. In one exemplary embodiment, ink compartment 141 stores and supplies black ink to printhead 130, and ink compartment 142 stores and supplies a color ink other than black ink, for example, yellow ink, to printhead 130.

In one embodiment, printhead 130 has a face 132 and includes a plurality of nozzles or orifices 134 formed in face 132. In one embodiment, nozzles or orifices 134 are arranged in one or more columns 150 of orifices 134. In one exemplary embodiment, printhead 130 includes a first column 151 of orifices 134, and a second column 152 of orifices 134. In one embodiment, first column 151 of orifices 134 communicates with first ink compartment 141 so as to eject a first color ink from printhead 130, and second column 152 of orifices 134 communicates with second ink compartment 142 so as to eject a second color ink from printhead 130.

In one embodiment, service station assembly 220 provides a system for capping and priming of printhead 130. As such, service station assembly 220 helps to prevent ink from drying in nozzles or orifices 134 when printhead 130 is not in use, and assists in removing air bubbles trapped in nozzles or orifices 134 and clearing out soft viscous plugs of ink which may form in nozzles or orifices 134 when printhead 130 is not in use.

In one embodiment, service station assembly 220 includes a cap 230, a porous material 240, and a vacuum 250. In one embodiment, cap 230 includes a base 232 and a perimeter wall 234 extending from base 232. In one embodiment, cap 230 mates with printhead 130 such that perimeter wall 234 surrounds printhead 130 and forms a seal with face 132 of printhead 130.

In one embodiment, base 232 of cap 230 includes a vacuum port 236. In one embodiment, vacuum port 236 communicates with vacuum 250 via a vacuum tube 252. In one embodiment, one end of vacuum tube 252 is communicated with vacuum port 236 and an opposite end of vacuum tube 252 is communicated with vacuum 250 such that vacuum pressure generated by vacuum 250 is communicated with cap 230. As such, vacuum pressure of vacuum 250 is applied to printhead 130 through vacuum tube 252 and cap 230 when printhead 130 mates with cap 230. In one embodiment, as described below, vacuum pressure within cap 230 draws ink (or fluid) from printhead 130 for servicing of printhead 130 when printhead 130 mates with cap 230.

In one embodiment, as illustrated in FIG. 2, porous material 240 is provided in cap 230. In one embodiment, porous material 240, absorbs ink (or fluid) from printhead 130 and forms a filter for ink (or fluid) from printhead 130. In one embodiment, porous material 240 is formed of an open-cell plastic. In one exemplary embodiment, porous material 240 has a pore volume of approximately 25 percent. In one exemplary embodiment, porous material 240 is a polyethylene foam or other functionally similar material.

As illustrated in the embodiment of FIG. 2, porous material 240 has a first side 241 and a second side 242. Second side 242 of porous material 240 is opposite first side 241 and, in one embodiment, oriented substantially parallel with first side 241. In one embodiment, porous material 240 is positioned in base 232 of cap 230 such that second side 242 of porous material 240 faces and/or contacts base 232. As such, first side 241 of porous material 240 faces or is oriented toward face 132 of printhead 130 when printhead 130 mates with cap 230.

In one embodiment, as illustrated in FIGS. 2, 3, 4, and 5, first side 241 of porous material 240 has a stepped or raised profile, and second side 242 of porous material 240 includes a recessed area. The stepped or raised profile of first side 241 of porous material 240 reduces a distance between porous material 240 and face 132 of printhead 130 when printhead 130 mates with cap 230, and the recessed area of second side 242 of porous material 240 provides an area or areas of reduced thickness of porous material 240. By providing an area or areas of reduced thickness of porous material 240, the recessed area of second side 242 provides an area or areas of reduced resistance and, therefore, increased pressure from vacuum 250. As such, the recessed area of second side 242 provides a distributed pressure profile which varies throughout porous material 240 and, therefore, cap 230.

In one embodiment, the recessed area of second side 242 of porous material 240 is formed by a recess 244 in porous material 240. In one embodiment, recess 244 communicates with vacuum port 236 of cap 230 when porous material 240 is positioned in base 232 of cap 230. By forming recess 244 in porous material 240, recess 244 provides an area or areas of reduced thickness of porous material 240 and, therefore, reduced resistance to vacuum pressure generated by vacuum 250. Thus, recess 244 provides an area or areas for increased application of pressure to porous material 240 and, therefore, cap 230 from vacuum 250. Accordingly, the area or areas of increased application of pressure to porous material 240 may be applied to printhead 130 when printhead 130 mates with cap 230.

In one embodiment, recess 244 is a T-shaped recess 260. As such, T-shaped recess 260 includes a base portion 261 and a cross portion 262 oriented substantially perpendicularly to base portion 261. In one embodiment, T-shaped recess 260 has a substantially uniform depth, and extends less than a full length of porous material 240. In one embodiment, T-shaped recess 260 is oriented such that base portion 261 is oriented substantially parallel with columns 150 of orifices 134, and cross portion 262 is oriented substantially perpendicular to columns 150 of orifices 134.

In one embodiment, as illustrated in FIGS. 2 and 3, ink compartment 141 storing and supplying black ink to printhead 130 communicates with a first end of printhead 130, and ink compartment 142 storing and supplying color ink other than black ink to printhead 130 communicates with a second end of printhead 130 opposite the first end. In one embodiment, flow of ink from ink compartment 141 to printhead 130 is illustrated by line 143.

In one exemplary embodiment, ink within ink compartment 141 is a black pigment-based ink, and ink within ink compartment 142 is a yellow dye-based ink. Under certain conditions, pigment of the ink within ink compartment 141 may settle within ink compartment 141 (as illustrated by 144 in FIG. 2) thereby producing a higher pigment concentration ink at the first end of printhead 130 (as illustrated by 145 in FIG. 2). As such, the higher pigment concentration ink, when mixed with the dye-based ink from ink compartment 142, may from sludge at the first end of printhead 130 (as illustrated by 135 in FIG. 3) and within cap 230 adjacent the first end of printhead 130.

In one embodiment, as illustrated in FIG. 3, cross portion 262 of T-shaped recess 260 is provided at an end of porous material 240 adjacent or corresponding to the first end of printhead 130. As such, T-shaped recess 260 provides an area of reduced resistance and increased application of pressure from vacuum 250 at the first end of printhead 130. Accordingly, T-shaped recess 260 provides for increased application of pressure to the first end of printhead 130 and, therefore, ink compartment 141 when printhead 130 mates with cap 230. Thus, T-shaped recess 260 improves flow of the more viscous sludge and higher pigment concentration ink which may be develop at the first end of printhead 130.

By providing recess 244 in porous material 240 of the shape and configuration illustrated and described herein, recess 244 helps to improve and regulate ink (or fluid) flow from printhead 130 while priming, and aids in balancing and distributing pressure within cap 230 and porous material 240 while priming. As such, recess 244 helps to achieve a predetermined flow pressure within cap 230 and porous material 240 to help reduce sludge formation on printhead 130 and within cap 230.

Although illustrated and described as being a T-shaped recess, it is within the scope of the present invention for recess 244 in porous material 240 to be of other shapes and/or configurations.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A system for servicing a printhead having a plurality of orifices formed in a face thereof, the system comprising:
- a cap configured to mate with the face of the printhead;
- a porous material provided in the cap, the porous material having a first side arranged to face the face of the printhead and a second side opposite the first side; and
- a vacuum port formed in the cap,
- wherein the second side of the porous material has a recess formed therein, wherein the recess is communicated with and open to the vacuum port.

2. The system of claim 1, wherein the cap includes a base, wherein the vacuum port is formed in the base, and wherein the second side of the porous material contacts the base.

3. The system of claim 1, further comprising:
- a vacuum communicated with the vacuum port, wherein the vacuum is configured to draw fluid from the orifices of the printhead through the porous material.

4. The system of claim 1, wherein the recess has a T-shaped profile formed in a surface of the second side of the porous material.

5. The system of claim 4, wherein the orifices of the printhead form at least one column of orifices, and wherein a cross portion of the T-shaped profile of the recess is oriented substantially perpendicular to the at least one column of orifices.

6. The system of claim 4, wherein the orifices of the printhead form at least one column of orifices, and wherein a base portion of the T-shaped profile of the recess is oriented substantially parallel with the at least one column of orifices.

7. A system for servicing a printhead having a plurality of orifices formed in a face thereof, the system comprising:
- a cap configured to mate with the face of the printhead;
- a porous material provided in the cap, the porous material having a first side arranged to face the face of the printhead and a second side opposite the first side; and
- a vacuum communicated with the cap, the vacuum configured to draw fluid from the orifices of the printhead through the porous material provided in the cap,
- wherein the second side of the porous material has a recess formed therein, and wherein the vacuum is communicated with the recess,
- wherein the recess is a T-shaped recess,
- wherein the printhead is part of a print cartridge including a black ink compartment communicated with a first end of the printhead and a non-black ink compartment communicated with a second end of the printhead, and wherein a cross portion of the T-shaped recess is provided at an end of the porous material adjacent the first end of the printhead.

8. A method of servicing a printhead having a plurality of orifices formed in a face thereof, the method comprising:
- providing a porous material in a cap for the printhead, the porous material having a first side and a second side opposite the first side;
- communicating a vacuum port formed in the cap with a recess formed in the second side of the porous material, the recess being open to the vacuum port;
- mating the cap with the face of the printhead, including providing the first side of the porous material adjacent the face of the printhead; and
- drawing fluid from the orifices of the printhead through the porous material with a vacuum communicated with the vacuum port.

9. The method of claim 8, wherein the cap includes a base, wherein the vacuum port is formed in the base, and wherein providing the porous material in the cap includes contacting the base of the cap with the second side of the porous material.

10. The method of claim 9, wherein providing the first side of the porous material adjacent the face of the printhead includes contacting the face of the printhead with the first side of the porous material.

11. The method of claim 8, wherein the recess has a T-shaped profile formed in a surface of the second side of the porous material.

12. The method of claim 11, wherein the orifices of the printhead form at least one column of orifices, and wherein providing the porous material in the cap includes orienting a cross portion of the T-shaped profile of the recess substantially perpendicular to the at least one column of orifices.

13. The method of claim 11, wherein the orifices of the printhead form at least one column of orifices, and wherein providing the porous material in the cap includes orienting a base portion of the T-shaped profile of the recess substantially parallel with the at least one column of orifices.

14. A method of servicing a printhead having a plurality of orifices formed in a face thereof, the method comprising:

providing a porous material in a cap for the printhead the porous material having a first side and a second side opposite the first side;

mating the cap with the face of the printhead, including providing the first side of the porous material adjacent the face of the printhead; and communicating a vacuum with the cap and drawing fluid from the orifices of the printhead through the porous material with the vacuum, including communicating the vacuum with a recess formed in the second side of the porous material, wherein the recess is a T-shaped recessed, wherein the printhead is part of a print cartridge including a black ink compartment communicated with a first end of the printhead and a non-black ink compartment communicated with a second end of the printhead, and wherein providing the porous material in the cap includes providing a cross portion of the T-shaped recess at an end of the porous material adjacent the first end of the printhead.

15. A system for servicing a printhead having a plurality of orifices formed in a face thereof, the system comprising:

means for capping the face of the printhead;

means for drawing fluid from the orifices of the printhead, the means for drawing fluid communicating with the means for capping the face of the printhead; and means for distributing pressure on the fluid drawn from the orifices of the printhead by the means for drawing fluid from the orifices, the means for distributing pressure on the fluid provided in the means for capping the face of the printhead, and the means for distributing pressure on the fluid including a recess communicated with and open to the means for drawing fluid from the orifices of the printhead.

16. The system of claim 15, wherein the recess of the means for distributing pressure on the fluid provides means for reducing a resistance to flow of the fluid in an area of the recess.

17. The system of claim 15, wherein the means for distributing pressure on the fluid provides means for varying pressure throughout the means for capping the face of the printhead.

18. The system of claim 15, wherein the means for distributing pressure on the fluid includes a porous material provided in the means for capping the face of the printhead, wherein the porous material has a first side facing the face of the printhead and a second side opposite the first side, and wherein the recess of the means for distributing pressure on the fluid is provided in the second side of the porous material.

19. The system of claim 15, wherein the recess of the means for distributing pressure on the fluid is a T-shaped recess.

20. The system of claim 19, wherein the orifices of the printhead form at least one column of orifices, and wherein the T-shaped recess includes a cross portion oriented substantially parallel with the face of the printhead and substantially perpendicular to the at least one column of orifices and a base portion oriented substantially parallel with the face of the printhead and substantially parallel with the at least one column of orifices.

* * * * *

UNITED STATES PATENT AND TRADEMARK OFFICE

CERTIFICATE OF CORRECTION

PATENT NO. : 8,172,360 B2
APPLICATION NO. : 12/257727
DATED : May 8, 2012
INVENTOR(S) : Chiok Liang Tay et al.

It is certified that error appears in the above-identified patent and that said Letters Patent is hereby corrected as shown below:

In column 7, line 6, in Claim 14, delete “printhead” and insert -- printhead, --, therefor.

Signed and Sealed this
Twenty-fifth Day of December, 2012

David J. Kappos

David J. Kappos
*Director of the United States Patent and Trademark Office*